US006176788B1

(12) United States Patent
Checketts

(10) Patent No.: US 6,176,788 B1
(45) Date of Patent: Jan. 23, 2001

(54) TRACK-MOUNTED RIDE POWERED BY COMPRESSED GAS

(76) Inventor: Stanley J. Checketts, 805 E. Canyon Rd., Providence, UT (US) 84332

( * ) Notice: Under 35 U.S.C. 154(b), the term of this patent shall be extended for 0 days.

(21) Appl. No.: 09/364,279

(22) Filed: Jul. 30, 1999

Related U.S. Application Data

(63) Continuation of application No. 09/071,530, filed on May 1, 1998, now abandoned.

(51) Int. Cl.[7] ..... A63G 1/34
(52) U.S. Cl. ..... 472/43; 472/89; 104/138.1
(58) Field of Search ..... 472/85, 88, 89, 472/43; 104/53, 63, 64, 65, 66, 138.1, 156

(56) References Cited

U.S. PATENT DOCUMENTS 4,347,791 * 9/1982 Mandros ..... 104/156

* cited by examiner

*Primary Examiner*—Kien T. Nguyen
(74) *Attorney, Agent, or Firm*—Thompson E. Fehr

(57) ABSTRACT

A track-mounted ride powered by compressed gas injected either into a tube surrounding the vehicle of the ride or into a housing having a piston connected to a catch that removably engages the vehicle. The track can be an open course or a closed course. Braking is accomplished either by braking systems traditionally utilized in the art of track-mounted amusement rides or by using a tube which the vehicle enters and in which the vehicle compresses air to produce pneumatic braking.

20 Claims, 9 Drawing Sheets

TRACK-MOUNTED RIDE POWERED BY COMPRESSED GAS

CROSS-REFERENCE TO RELATED APPLICATION

This is a continuation of U.S. application Ser. No. 09/071,530, filed on May. 1, 1998, now abandoned.

BACKGROUND OF THE INVENTION

1. Field of the Invention

This invention relates to an amusement ride which employs fluid dynamics to accelerate an object, especially a participant, in a vehicle that forms part of a track-mounded ride.

2. Description of the Related Art

The traditional roller coaster utilizes a chain drive to pull one or more vehicles to the highest point on the track and thereby create significant potential energy. Gravity then accelerates the vehicle downhill, exchanging potential energy for kinetic energy. Sufficient kinetic energy is recovered to permit the vehicle to ascend a subsequent incline, thereby converting kinetic energy into potential energy. Energy losses, of course, dictate that each subsequent hill be smaller. Curves are also incorporated in the track, ultimately creating a closed course, viz., a course where the end of the track is connected to the beginning of the track. The chain drive is necessarily limited in a capability for acceleration and, consequently, moves the vehicle at quite slow speeds.

A more modern version of the roller coaster utilizes a series of linear induction motors to create the initial acceleration for a roller coaster. One such ride has been produced by Premier Rides for Six Flags Them Parks Inc. and is termed the BATMAN & ROBIN ride. The present inventor could, however, locate no patent for coasters which are initially accelerated by linear induction motors. Many linear induction motors are required to accelerate the vehicle, and such motors are quite susceptible to failure.

The only roller coaster of which the present inventor is aware which is powered by a pressurized gas is the Tubular Roller Coaster of U.S. Pat. No. 5,193,462. Though, as the name of this device implies, the entire movement of the vehicle is within a tube, which substantially detracts from the desired excitement participants on roller coasters derive from being in an open environment where such participants can feel the air rush past them and visibly perceive speed and changes in elevation. Although U.S. Pat. No. 5,193,462 does not explicitly state that air is continuously injected into the tube in order to push the vehicle, this is strongly suggested by the drawing and the language in the disclosure which designates "a blower 5 which propels the wheeled containers/capsules 6 along the tubular route 1 . . . "

A similar suggestion of continuous air movement applies to the improved pneumatic car-truck described and claimed in U.S. Pat. No. 64,401. That patent states, in pertinent part, " . . . the truck . . . can be propelled by the air currents in the pneumatic tube in the usual manner."

Finally, U.S. Pat. No. 5,417,615 utilizes pressurized gas vertically to eject a vehicle from a tube. Gravity eventually stops the vehicle so that it falls along a guide cable back into the tube, where compression of air decelerates the vehicle at a rate controlled by pressure relief valves. Just as in the case of U.S. Pat. No. 5,193,462, however, the participant is completely enclosed by the vehicle. Furthermore, no track is contemplated by the invention of U.S. Pat. No. 5,417,615.

SUMMARY OF THE INVENTION

The present invention utilizes pressurized gas to provide the initial acceleration to the vehicle of a track-mounted ride in lieu of the traditional chain drive or the more modern but failure-prone linear induction motors. Subsequent acceleration may occur through the descent of the vehicle from a height to which the initial acceleration had enabled the vehicle to attain. It is, however, not necessary to supply compressed gas throughout the ride, as appears to be the case with U.S. Pat. No. 5,193,462.

There are two primary methods of employing the pressurized gas to accelerate the vehicle. The preferred method is to accelerate a catch which releasably engages the vehicle.

The catch may be accelerated by the Pneumatic Device for Accelerating and Decelerating Objects of U.S. Pat. No. 5,632,686, which patent is hereby incorporated by reference and which Device—for convenience—will herein be termed the "Pneumatic SPACE SHOT Accelerator"; by the Device for Accelerating and Decelerating Objects of pending U.S. patent application Ser. No. 08/862,841, which application is owned by the present inventor, which application was filed on May 23, 1997, which application is hereby incorporated by reference, and which Device—for convenience—will herein be termed the "Gas-based SPACE SHOT Accelerator"; by the Device for Accelerating and Decelerating Objects of U.S. Pat. No. 5,704,841, which patent is hereby incorporated by reference and which Device—for convenience—will herein be termed the "TURBO DROP Accelerator"; or by a TURBO DROP Accelerator where the cable has been replaced by a rod to which the catch has been connected, which—for convenience—will herein be termed the "Rod-containing TURBO DROP Accelerator".

In the cases of the Pneumatic SPACE SHOT Accelerator, the Gas-based SPACE SHOT Accelerator, and the TURBO DROP Accelerator, the carrier is replaced by the catch of the present invention. The catch is then accelerated as described for the carrier in the relevant patents and patent application. The SPACE SHOT Accelerator and the Gas-based SPACE SHOT Accelerator would be the embodiments of the relevant patent and patent application which do not have a second guide pulley. And, preferably, the TURBO DROP Accelerator and the Rod-containing TURBO DROP Accelerator would be operated in the second mode, i.e., the "boost and stop" mode described on line 8 through line 34 in column 7 of U.S. Pat. No. 5,704,841.

It should be observed, however, that the inventions of U.S. Pat. No. 5,632,686, of pending application Ser. No. 08/862,841, and of U.S. Pat. No. 5,704,841 accelerate and decelerate only a carrier that is an integral portion of the inventions of those patents and which never is detached from the device of the invention. Until the present invention, no one had conceived that the carrier could be replaced with a catch that could accelerate a vehicle that would then be detached from the accelerator and move independently. And this is especially true in the field of roller coasters where the linear induction motor has been a less than ideally successful attempt to fill the long-sought need of replacing the old mechanical chain drive.

The second primary method for employing the pressurized gas to accelerate the vehicle is to propel the vehicle from a tube open only at the end from which the vehicle exits. Attached to the other end of the tube is a source of compressed gas, preferably air.

Near the rear of the vehicle, a shield is attached to the vehicle. The shield has a cross section that is shaped approximately the same as the cross section of the tube from which the vehicle is initially propelled. The cross section of the shield is, however, slightly smaller than the cross section of the tube. (Of course, the body of the vehicle may be so designed that it forms the shield rather than having a separate shield attached to the vehicle.)

When it is desired to propel the vehicle from the tube, the compressed gas is rapidly injected through a valve into the closed first end of the tube. Since the shield covers most of the cross section of the tube, as the injected compressed gas expands, the vehicle is forced toward and through the open second end of the tube. The momentum of the vehicle then carries it along the path of the track.

Preferably, the size of the shield is sufficiently large that relatively low-pressure compressed air can be utilized.

Again there is only an initial acceleration, replacing the traditional chain drive or the linear induction motors. There is not a continuous supply of compress gas, as appears to be the case with U.S. Pat. No. 5,193,462.

Additionally, unlike the track of U.S. Pat. No. 5,193,462, the track of the present invention preferably does not, when a vehicle is being used, enclose the vehicle. This is feasible since a continuous supply of air is not required to move the vehicle along the track; a supply of air is required only during the initial acceleration, after which the vehicle moves because of its own inertia (and, of course, that of any participants riding in the vehicle). And not having the track enclose the vehicle enables the participant to have a more complete visual experience and to feel the movement of the air as the vehicle speeds along.

The track could be straight or curved but is preferably curved with changes in elevation similar to, or even more pronounced than, that of existing roller coasters. Complete vertical loops could also be included. The track can also either be an open course or a closed course but is preferably a closed course.

In an additional option, the track could be straight but curve from horizontal to vertical. In such a case, the vehicle would initially be accelerated toward the top of the track. Gravity or a combination of gravity and brakes would bring the vehicle to a stop near the top of the track. Gravity or, if the braking system were to employ an energy storage device such as a spring or air spring, gravity plus the reaction of the braking system would then cause the vehicle to descend from the top of the track.

With respect to any of the embodiments, to stop the movement of the vehicle on the track, any of the braking systems traditionally utilized in the art of track-mounted amusement rides can be used. Alternatively, however, a pneumatic braking system can be employed.

DESCRIPTION OF THE PREFERRED EMBODIMENT

Figure 1:
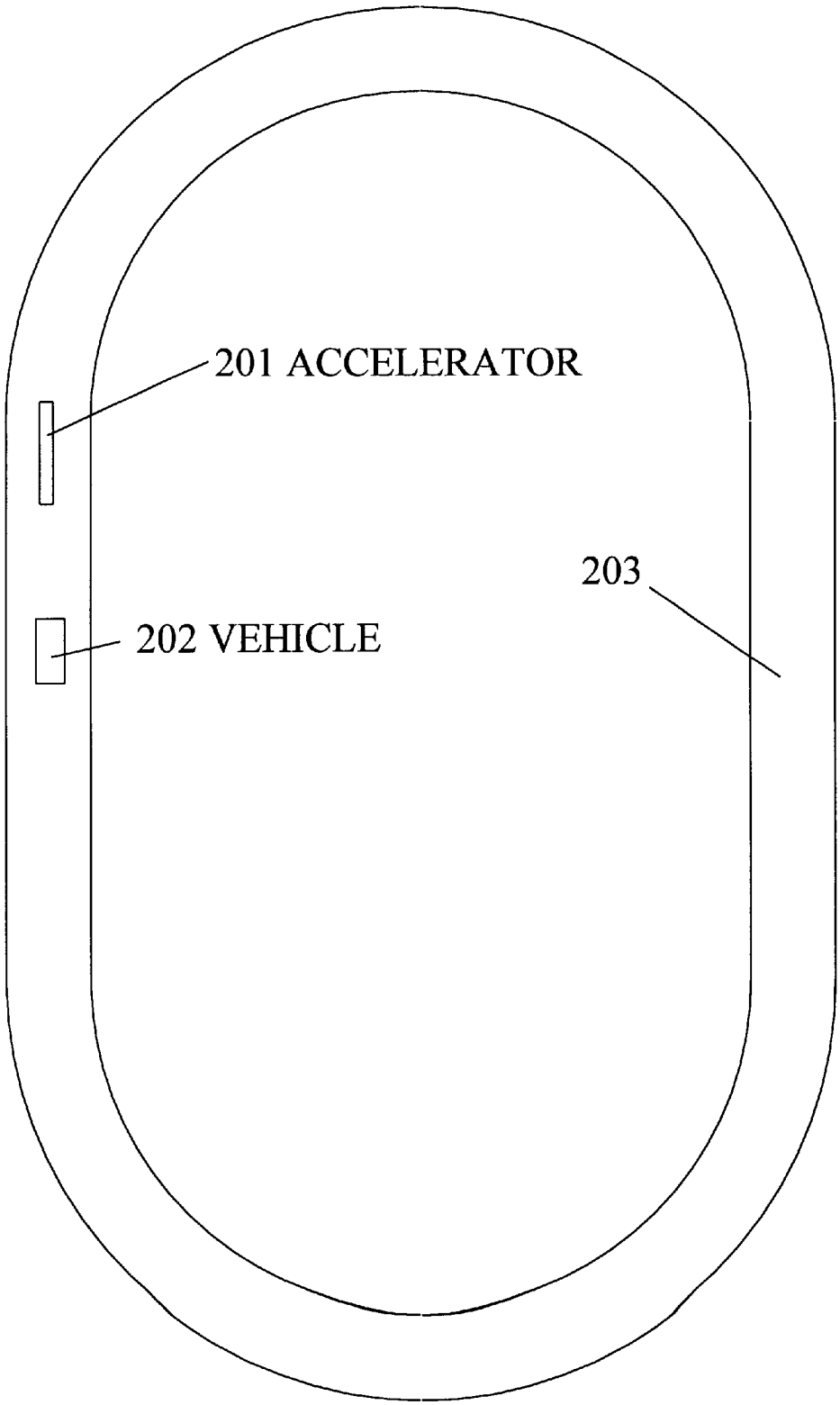
FIG. 1 depicts a closed-course track with an accelerator that utilizes a catch to engage and accelerate the vehicle of the ride.

As depicted in FIG. 1, an accelerator 201 provides the initial acceleration to propel a vehicle 202 around a track 203.

Figure 2:
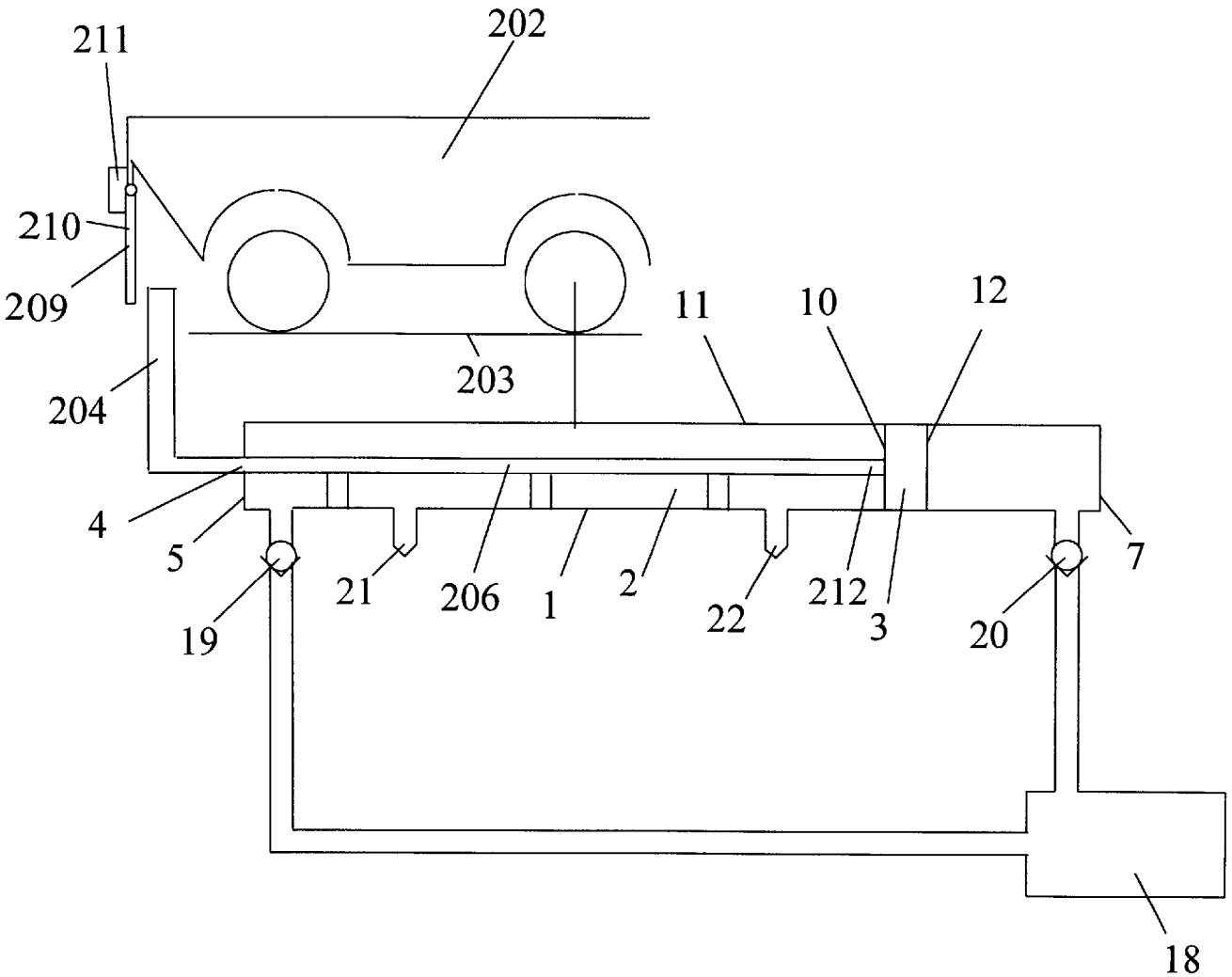
FIG. 2 illustrates the Rod-containing TURBO DROP Accelerator and the vehicle with a stop.

The preferred method for accelerating the vehicle 202 is to accelerate a catch 204 which releasably engages the vehicle 202, as illustrated in FIG. 2.

As explained above, the catch 204 may be accelerated by the Pneumatic SPACE SHOT Accelerator, by the Gas-based SPACE SHOT Accelerator, by the TURBO DROP Accelerator, or by the Rod-containing TURBO DROP Accelerator.

The accelerator 201 may be placed in any orientation but is preferably horizontal in order to facilitate a participant's entering and exiting the vehicle 202. Additionally, the accelerator 201 is maintained in fixed position relative to the track 203; this is preferably accomplished by having both the track 203 and the accelerator 201 attached to the ground. Alternatively, the accelerator 201 could be connected to the track 203.

Figure 3:
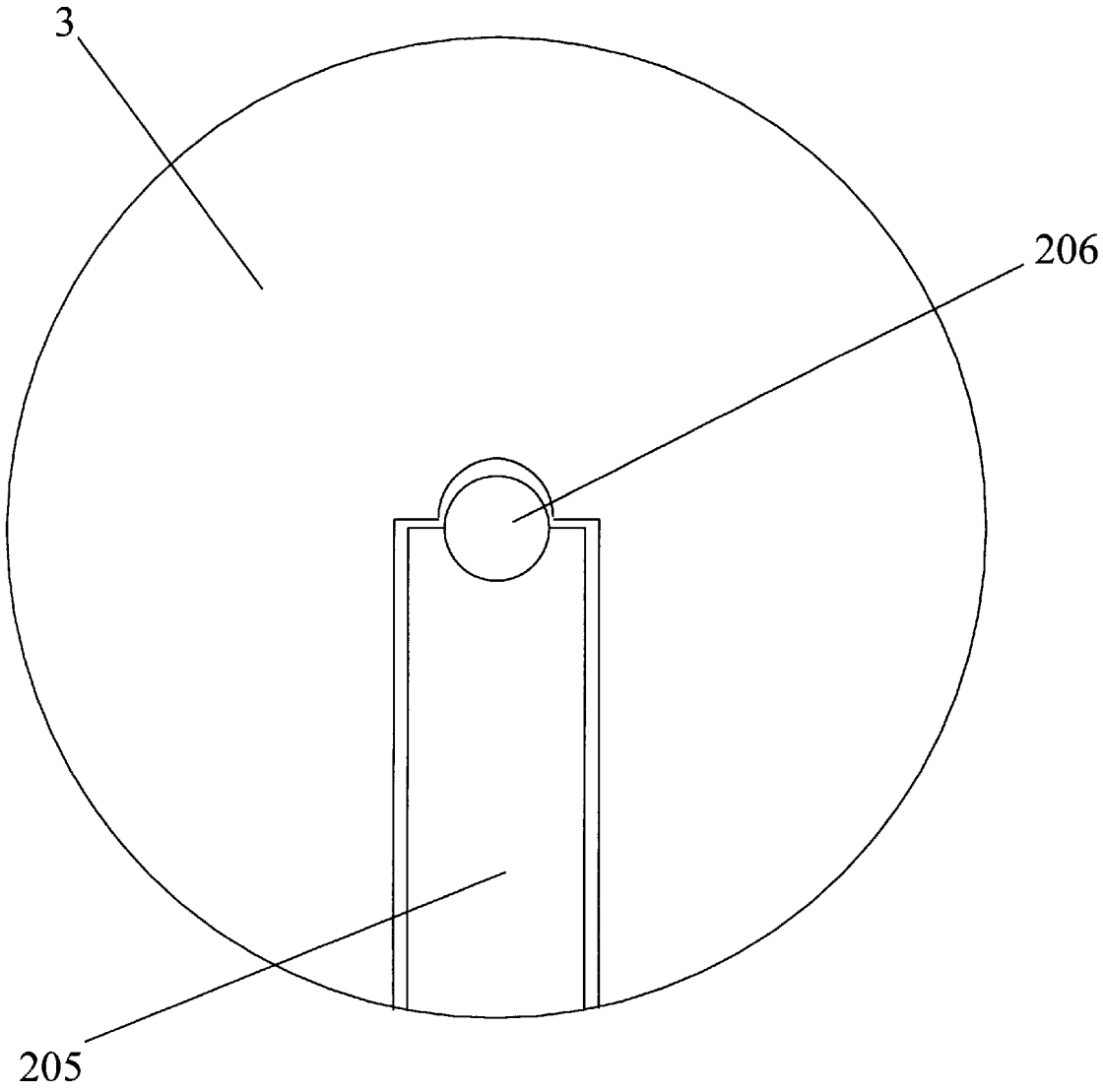
FIG. 3 is a cross-sectional view for the embodiment of FIG. 3.

When the Rod-containing TURBO DROP Accelerator is in a horizontal orientation, it is preferable to have supports 205 for the rod 206, as shown in FIG. 3, which minimize the possibility for bending of the rod 206.

The supports 205 may be placed only inside the housing 1 or may be both inside and outside the housing 1.

Figure 4:
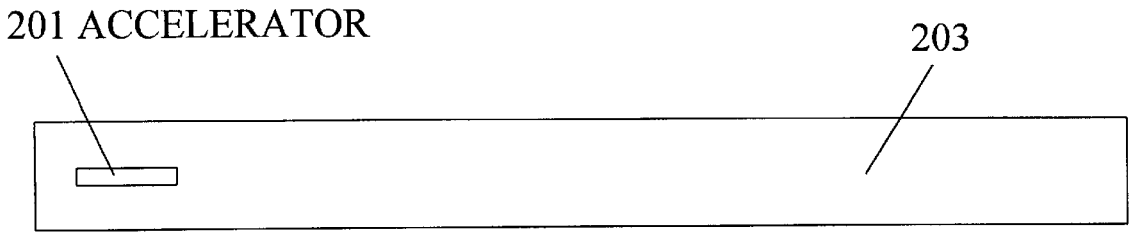
FIG. 4 portrays an open-course track with an accelerator that utilizes a catch to engage and accelerate the vehicle of the ride.

The track 203, as stated above, preferably does not, when a vehicle 202 is being used, enclose the vehicle 202 and can be straight or curved but is preferably curved with changes in elevation similar to, or even more pronounced than, that of existing roller coasters. Complete vertical loops could also be included. The track 203 can additinally either be an open course, as illustrated in FIG. 4, or a closed course, as depicted in FIG. 1, but is preferably a closed course.

Figure 5:
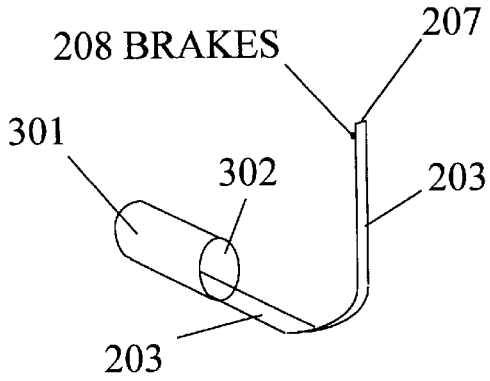
FIG. 5 shows an open-course track where a tube is used as the accelerator.

Also as discussed above and as portrayed in FIG. 5, in an additional option, the track 203 could be straight but curve from horizontal to vertical. In such a case, the vehicle 202 would initially be accelerated toward the top 207 of the track. Gravity or a combination of gravity and brakes 208 would bring the vehicle to a stop near the top 207 of the track 203. Gravity or, if the braking system 208 were to employ an energy storage device such as a spring or air spring, gravity plus the reaction of the braking system 208 would then cause the vehicle 202 to descend from the top 207 of the track 203.

When the vehicle 202 may return to the location of the accelerator 201, either because the track 203 curves from horizontal to vertical as described in the immediately preceding paragraph or because the track 203 is a closed course it is necessary to assure that the catch 204 will not interfere with the movement of the vehicle 202. The preferred method for accomplishing this with the closed course is to have the portion 209 of the vehicle 202 which is engaged by the catch 204 rotatably attached to the vehicle 202 in such a manner that such portion 209 will rotate when the front 210 of the vehicle 202 pushes against the catch 204 as the vehicle 202 moves forward but not when the catch 204 pushes against such portion 209 from behind the front 210 of the vehicle 202. An example of a method for doing this would be simply to attach a stop 211 to the front 210 of the vehicle.

Alternatively, just after passing the accelerator 201, the track 203 could curve upward or laterally so that after the catch 204 had completed its movement, it would no longer be within the track 203. In a further option, after the catch 204 has completed accelerating the vehicle 202, the catch 204 could rotate so that it would not rise above the track 203.

With respect to any of the embodiments, to stop the movement of the vehicle 202 on the track 203, any of the braking systems traditionally utilized in the art of track-mounted amusement rides can be used. Alternatively, however, a pneumatic braking system can be employed.

Figure 6:
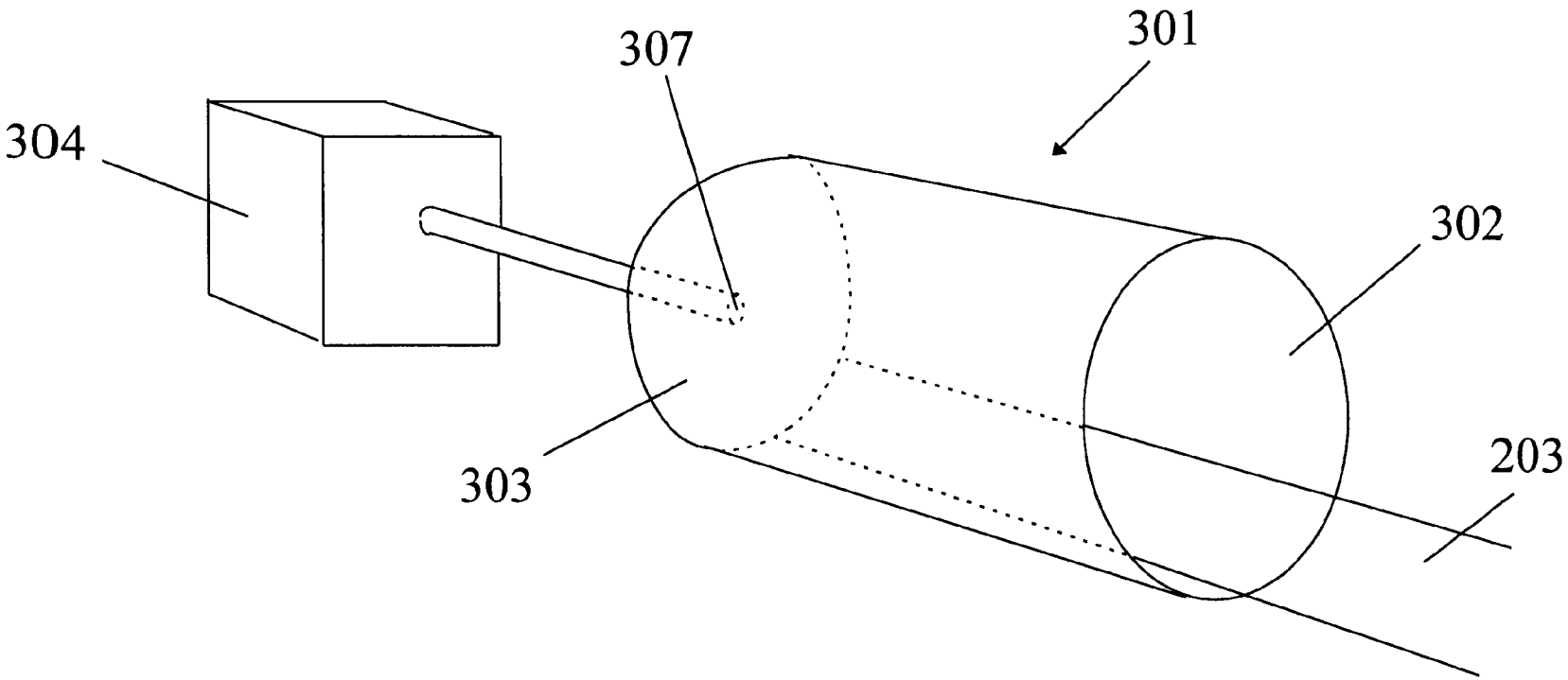
FIG. 6 illustrates details of a tube used as an accelerator.

Again as discussed earlier and as portrayed in FIG. 6, the second primary method for employing the pressurized gas to accelerate the vehicle 202 is to propel the vehicle from a tube 301 open only at the end 302 from which the vehicle exits. Attached to the other end 303 of the tube 302 is a source 304 of compressed gas, preferably air.

Figure 7:
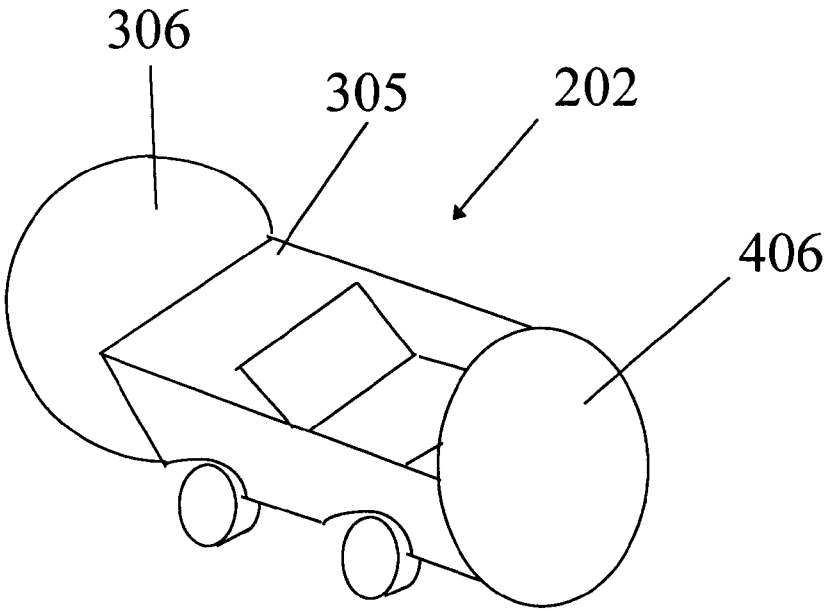
FIG. 7 depicts the vehicle that is employed when a tube is utilized for the accelerator.

Near the rear 305 of the embodiment of the vehicle 202 which is accelerated from the tube 301 and which is illustrated in FIG. 7, a shield 306 is attached to the vehicle 202. The shield 306 has a cross section that is shaped approximately the same as the cross section of the tube 301 from which the vehicle 202 is initially propelled. The cross section of the shield 306 is, however, slightly smaller than the cross section of the tube 301. (Of course, the body of the vehicle 202 may be so designed that it forms the shield 306 rather than having a separate shield 306 attached to the vehicle.)

When it is desired to propel the vehicle 202 from the tube 301, the compressed gas is rapidly injected through a valve 307, which valve 307 is attached to both the source 304 of compressed gas and the tube 301 and communicates with both the source 304 of compressed gas and the tube 301, into the tube 301 near the closed first end 303 of the tube 301. Since the shield 306 covers most of the cross section of the tube 301, as the injected compressed gas expands, the vehicle 202 is forced toward and through the open second end 302 of the tube 301. After this initial acceleration, the momentum of the vehicle 202 then carries it along the path of the track 203.

Preferably, the size of the shield 306 is sufficiently large that relatively low-pressure compressed air can be utilized.

As before, to stop the movement of the vehicle 202 on the track 203, any of the braking systems traditionally utilized in the art of track-mounted amusement rides can be used. Alternatively, however, a pneumatic braking system can be employed.

Figure 8:
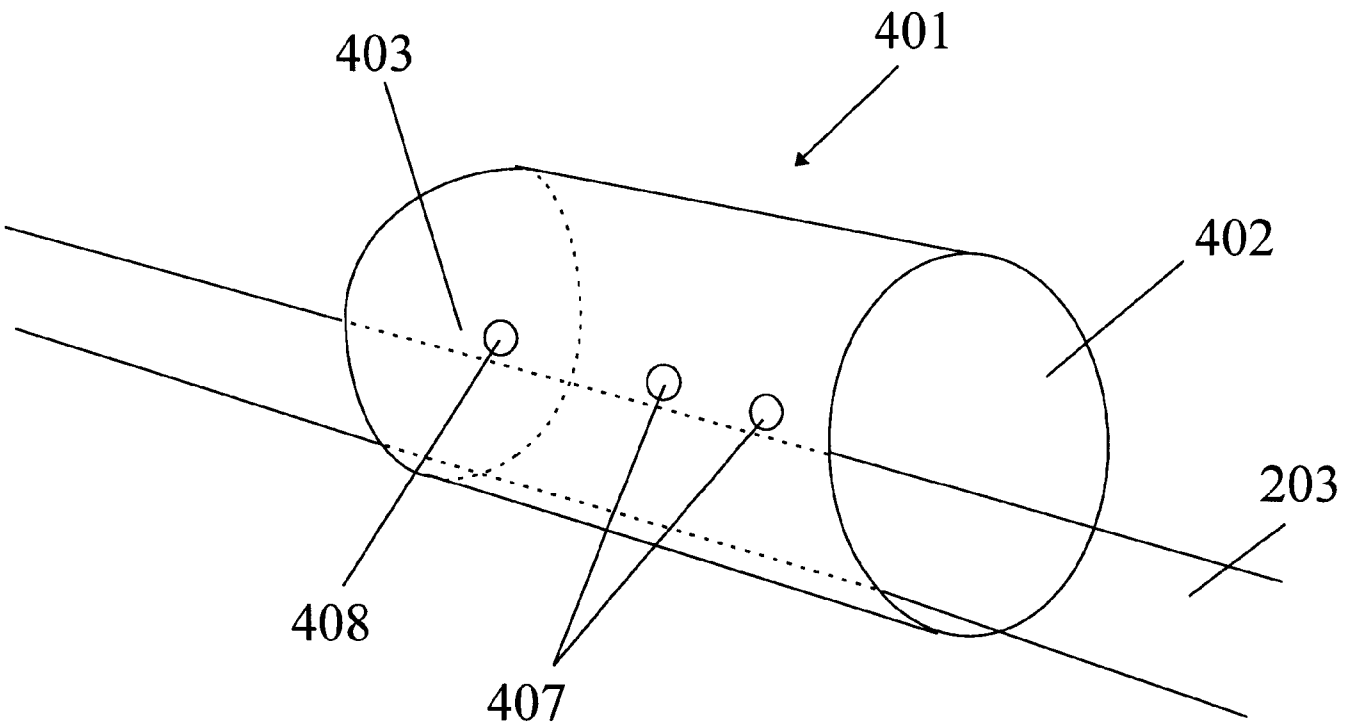
FIG. 8 provides a view of the details of a deceleration tube.

The pneumatic braking system, which is depicted in FIG. 8, includes a deceleration tube 401.

For any vehicle 202 which will enter a deceleration tube in the forward direction, a forward shield 406 is attached near the front 210 of the vehicle 202. The first end 403 of the deceleration tube is closed. As the vehicle 202 moves into the deceleration tube 401 through the open second end 402 of the deceleration tube 401, the forward shield 406 begins to compress the air within the deceleration tube 401 and, therefore, to create a pneumatic force which opposes the motion of, and decelerates, the vehicle 202. The length of the deceleration tube 401 is selected to be of such distance that the forward shield 406 will create sufficient pneumatic force that the vehicle 202 will stop before reaching the first end 403 of the deceleration tube 401. The length of the tube 401 may also be selected so that a desired rate of deceleration will be attained. Alternatively, the rate of deceleration could be controlled either by apertures 407 that are always open or by valves 408 in the wall 409 of the deceleration tube 401. (Of course, such valves 408 or apertures 407 could be utilized in conjunction with the length of the deceleration tube 401 to achieve the desired rate of deceleration.)

Moreover, if the track 203 is a closed course, the tube 301 which is used to accelerate the vehicle 202 can also be used as the deceleration tube 401. In such an embodiment, both the first end 303 and the second end 302 of the tube 301 are capable of opening and closing. When the tube 301 is used to accelerate the vehicle 202, the first end 303 of the tube 301 is closed; and the second end 302 of the tube 301 is open. Conversely, when the tube 301 is used to decelerate the vehicle, the first end 303 of the tube 301 is open; and the second end 302 of the tube 301 is closed.

In the case of the vertical track 203 where the vehicle 202 initially stops near the top 207 of the track 203, the tube 301 can serve both to accelerate and decelerate the vehicle while having a first end 303 which is permanently closed and a second end 302 that is permanently open.

A still further alternative for decelerating the vehicle 202 would be to combine the pneumatic braking system of the present invention with one or more of the traditional braking systems for track-mounted amusement rides.

Next, consideration must be given to the modifications of the TURBO DROP Accelerator that are necessary in order to create the Rod-containing TURBO DROP Accelerator, which is illustrated in FIG. 2 and FIG. 4.

The cable 9, the first pulley 14, the second pulley 15, and the carrier 16 are eliminated. The second aperture 6 is closed. A first end 212 of the rod 206 is attached to the side 10 of the piston 3 which is nearer the first end 5 of the housing 1. The rod 206 then passes through the first aperture 4 before being attached to the catch 204.

First input valve 19 and second input valve 20 can be operated so that the vehicle 202 will be accelerated either when the rod 206 is pushed farther out of the housing 1, because gas has been rapidly injected through second input valve 20, or when the rod 206 is pulled farther into the housing 1, because has been rapidly injected through first input valve 19. The rod 206 and catch 204 can be returned to their initial positions by relatively slowly injected air through the input valve 19 or 20 that was not used to accelerate the vehicle 202.

Figure 9:
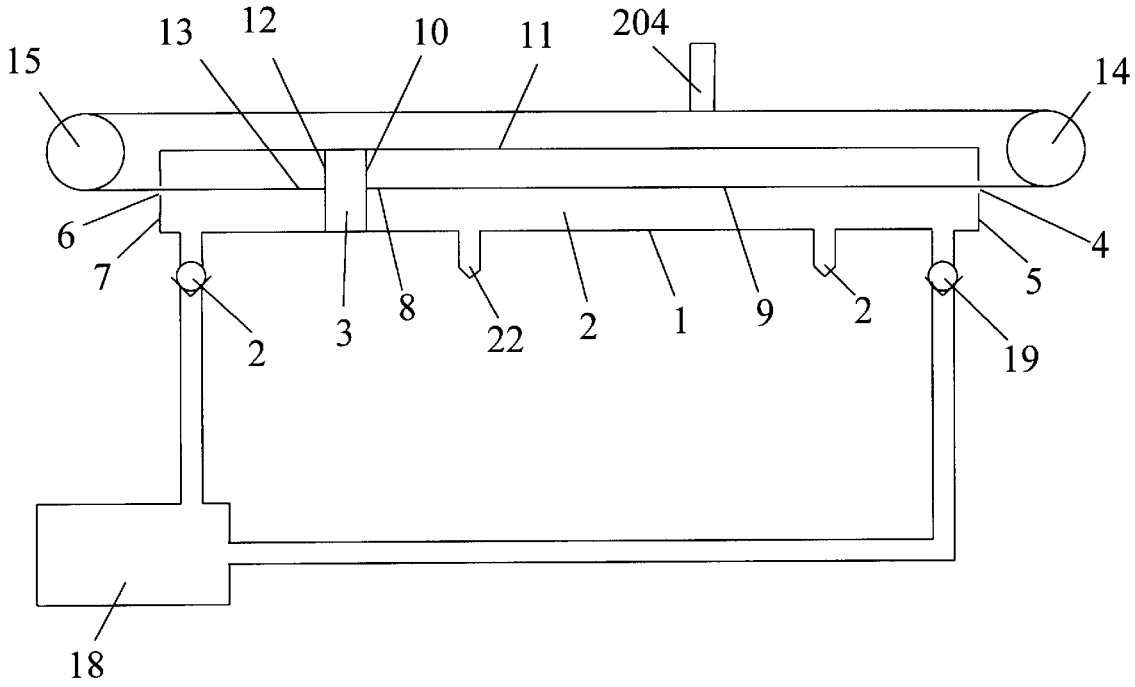
FIG. 9 portrays the TURBO DROP Accelerator.
Figure 10:
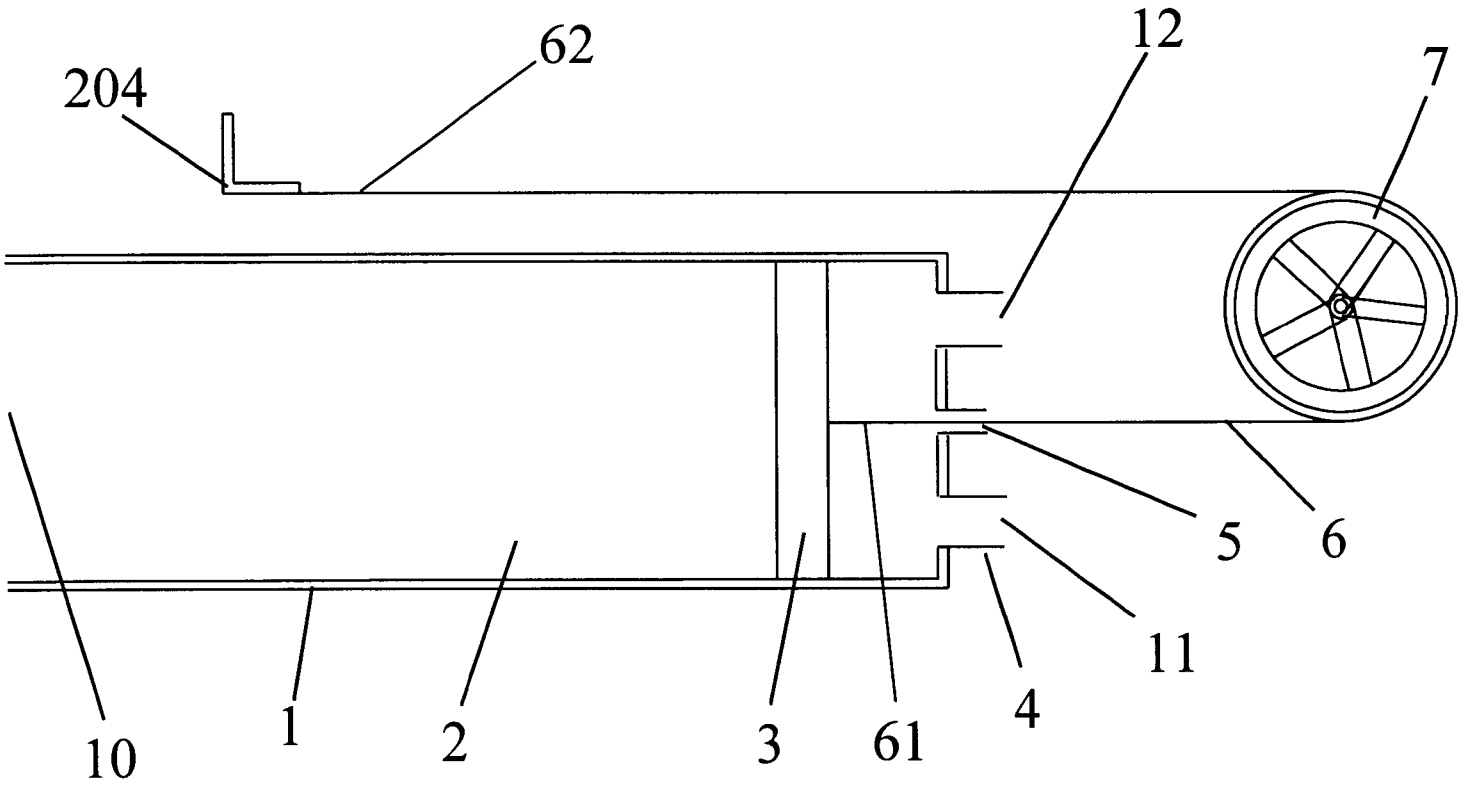
FIG. 10 shows the Pneumatic SPACE SHOT Accelerator and the Gas-based SPACE SHOT Accelerator.

Finally, FIG. 9 illustrates the TURBO DROP Accelerator, utilizing the numbers for identifying elements that are employed in U.S. Pat. No. 5,704,841, except for the catch 204. And, since the physical structure of both is identical, FIG. 10 depicts both the Pneumatic SPACE SHOT Accelerator and the Gas-based SPACE SHOT Accelerator, utilizing the numbers for identifying elements that are employed in U.S. Pat. No. 5,632,686 and U.S. patent application Ser. No. 08/862,841, except for the catch 204.

I claim:

1. A track-mounted ride powered by compressed gas, which comprises:

a track that does not enclose any vehicle that is placed on the track;

a vehicle which travels on the track; and a means for providing only an initial acceleration to said vehicle on said track.

2. A track-mounted ride powered by compressed gas, which comprises:

a track that does not enclose any vehicle that is placed on the track;

a vehicle which travels on the track; and a means for accelerating the vehicle on the track wherein said means for accelerating the vehicle on the track is a Rod-containing TURBO DROP Accelerator having a catch that releasably engages said vehicle in order to transfer an accelerating force from the Rod-containing TURBO DROP Accelerator to said vehicle, said Rod-containing TURBO DROP Accelerator being maintained in fixed position relative to said track.

3. The track-mounted ride powered by compressed gas as recited in claim 2, further comprising:

brakes to stop the movement of the vehicle on the track.

4. The track-mounted ride powered by compressed gas as recited in claim 2, wherein:

said track is a closed course.

5. The track-mounted ride powered by compressed gas as recited in claim 4, further comprising:

brakes to stop the movement of the vehicle on the track.

6. A track-mounted ride powered by compressed gas, which comprises:

a track that does not enclose any vehicle that is placed on the track;

a vehicle which travels on the track; and a means for accelerating the vehicle on the track wherein said means for accelerating the vehicle on the track is a TURBO DROP Accelerator having a catch that releasably engages said vehicle in order to transfer an accelerating force from the TURBO DROP Accelerator to said vehicle, said TURBO DROP Accelerator being maintained in fixed position relative to said track.

7. The track-mounted ride powered by compressed gas as recited in claim 6, further comprising:

brakes to stop the movement of the vehicle on the track.

8. The track-mounted ride powered by compressed gas as recited in claim 6, wherein:

said track is a closed course.

9. The track-mounted ride powered by compressed gas as recited in claim 8, further comprising:

brakes to stop the movement of the vehicle on the track.

10. A track-mounted ride powered by compressed gas, which comprises:

a track that does not enclose any vehicle that is placed on the track;

a vehicle which travels on the track; and a means for accelerating the vehicle on the track wherein said means for accelerating the vehicle on the track is a Gas-based SPACE SHOT Accelerator having a catch that releasably engages said vehicle in order to transfer an accelerating force from the Gas-based SPACE SHOT Accelerator to said vehicle, said Gas-based SPACE SHOT Accelerator being maintained in fixed position relative to said track.

11. The track-mounted ride powered by compressed gas as recited in claim 10, further comprising:

brakes to stop the movement of the vehicle on the track.

12. The track-mounted ride powered by compressed gas as recited in claim 10, wherein:

said track is a closed course.

13. The track-mounted ride powered by compressed gas as recited in claim 12, further comprising:

brakes to stop the movement of the vehicle on the track.

14. A track-mounted ride powered by compressed gas, which comprises:

a track that does not enclose any vehicle that is placed on the track;

a vehicle which travels on the track; and a means for accelerating the vehicle on the track wherein said means for accelerating the vehicle on the track is a Pneumatic SPACE SHOT Accelerator having a catch that releasably engages said vehicle in order to transfer an accelerating force from the SPACE SHOT Accelerator to said vehicle, said Pneumatic SPACE SHOT Accelerator being maintained in fixed position relative to said track.

15. The track-mounted ride powered by compressed gas as recited in claim 14, further comprising:

brakes to stop the movement of the vehicle on the track.

16. The track-mounted ride powered by compressed gas as recited in claim 14, wherein:

said track is a closed course.

17. The track-mounted ride powered by compressed gas as recited in claim 16, further comprising:

brakes to stop the movement of the vehicle on the track.

18. A track-mounted ride powered by compressed gas, which comprises:

a track that does not enclose any vehicle that is placed on the track;

a vehicle which travels on the track; and a means for accelerating the vehicle on the track wherein said means for accelerating the vehicle on the track comprises a tube having a closed first end and an open second end;

a source of compressed gas; and a valve connected to, and communicating with, both said source of compressed gas and said tube, near the closed first end of said tube; and wherein:

said vehicle has a shield near the rear of said vehicle, which shield has a cross section that is shaped approximately the same as the cross section of the said tube but that is slightly smaller than the cross section of said tube so that, as compressed gas is injected through said valve, the injected compressed gas expands and forces the vehicle toward and through the open second end of said tube.

19. The track-mounted ride powered by compressed gas as recited in claim 18, wherein:

said track is an open course that curves from horizontal to vertical.

20. The track-mounted ride powered by compressed gas as recited in claim 19, further comprising:

valves in the walls of said tube so that as said vehicle re-enters the open second end of said tube, the rate of deceleration caused by the shield's compressing air is controlled by the amount of air which said valves permit to leave the tube.

* * * * *